US006769891B2

(12) United States Patent
Morselli

(10) Patent No.: US 6,769,891 B2
(45) Date of Patent: Aug. 3, 2004

(54) ROTARY POSITIVE-DISPLACEMENT PUMP WITH MESHING GEAR WHEELS WITHOUT ENCAPSULATION, AND GEAR WHEEL FOR SUCH A POSITIVE-DISPLACEMENT PUMP

(76) Inventor: Mario Antonio Morselli, Via del Carmine, 23, 41100 Modena (IT)

( * ) Notice: Subject to any disclaimer, the term of this patent is extended or adjusted under 35 U.S.C. 154(b) by 0 days.

(21) Appl. No.: 10/453,294

(22) Filed: Jun. 3, 2003

(65) Prior Publication Data

US 2003/0231972 A1 Dec. 18, 2003

(30) Foreign Application Priority Data

Jun. 12, 2002 (EP) ..... 02425384

(51) Int. Cl.[7] ..... F04C 2/16; F04C 2/18
(52) U.S. Cl. ..... 418/206.5; 418/201.3; 74/462
(58) Field of Search ..... 418/201.3, 206.5; 74/457, 458, 460, 462

(56) References Cited

U.S. PATENT DOCUMENTS

| | | | | | |
|---|---|---|---|---|---|
| 1,442,018 | A | * | 1/1923 | Wendell | 74/462 |
| 2,159,744 | A | * | 5/1939 | Maglott | 418/201.3 |
| 3,209,611 | A | * | 10/1965 | Hitosi | 74/462 |
| 4,794,540 | A | | 12/1988 | Gutman et al. | 364/474.29 |
| 5,028,855 | A | | 7/1991 | Distler et al. | 318/568.13 |

FOREIGN PATENT DOCUMENTS

| | | |
|---|---|---|
| EP | 1 132 618 | 9/2001 |
| WO | WO 01/44693 A1 | 6/2001 |

* cited by examiner

*Primary Examiner*—John J. Vrablik
(74) *Attorney, Agent, or Firm*—Flynn, Thiel, Boutell & Tanis, P.C.

(57) ABSTRACT

A rotary positive-displacement pump comprises two gear wheels which mesh with each other without encapsulation. Each gear wheel has a plurality of teeth with a profile which falls within a band of tolerance of ±1/20th of the depth of the tooth with respect to a theoretical profile similar to a profile defined by a natural spline function passing through a plurality of nodal points having pre-established coordinates {X, Y}.

2 Claims, 7 Drawing Sheets

ROTARY POSITIVE-DISPLACEMENT PUMP WITH MESHING GEAR WHEELS WITHOUT ENCAPSULATION, AND GEAR WHEEL FOR SUCH A POSITIVE-DISPLACEMENT PUMP

FIELD OF INVENTION

This invention relates to the sector of rotary positive-displacement pumps. Various types of rotary pumps are known, amongst which are gear pumps, lobe pumps and screw pumps.

BACKGROUND OF THE INVENTION

Gear pumps generally consist of two gear wheels, one of which, termed the driving gear, is connected to a drive shaft and drives the other gear, termed the driven gear, in rotation.

Document EP-1 132 618 by the same applicant, relates to a rotary positive-displacement gear pump in which the gear wheels comprise a plurality of meshing teeth without encapsulation and at the same time incorporating helical teeth with face contact substantially equal or close to unity. The combination of a tooth profile which avoids encapsulation and the helical development of the teeth reduces the ripple and noise resulting from it while the pump is operating.

SUMMARY OF THE INVENTION

Experiments carried out by the applicant on various gears to be used in pumps of known type of the type indicated above revealed that there is a defined range of tooth profiles which can be effective both in reducing the noise of the pump and at the same time in making manufacture relatively simple, which may assist in containing the production costs of positive-displacement pumps. Moreover, this series of specifically identified profiles has the advantage of a high level of reliability in use, which makes its use in positive-displacement pumps for high pressures particularly advantageous.

In order to achieve the aims indicated above, the subject of the invention is a gear wheel with a plurality of teeth capable of meshing with the teeth of another corresponding gear wheel, the profile of each tooth of the gear wheel, in cross-section, being defined in the claims below.

In particular, the profile of at least one tooth of one of the two rotors is defined by a natural spline function passing through a plurality of nodal points having pre-established coordinates, with a tolerance of ±1/20th of the depth of the tooth on the theoretical profile defined by the plurality of preferred nodal points. The nodal points are defined by a pair of values {X', Y'} expressed in a system of Cartesian coordinates having their origin at the centre of the pitch circle of the gear wheel.

A further subject of this invention is a rotary positive-displacement pump comprising a pair of meshing gear wheels having a tooth profile of the type indicated above.

BRIEF DESCRIPTION OF THE DRAWINGS

Further characteristics and advantages will emerge from the description below of a preferred form of embodiment, with reference to the attached drawings, given purely as a non-limiting example, in which.

DETAILED DESCRIPTION

Figure 1:
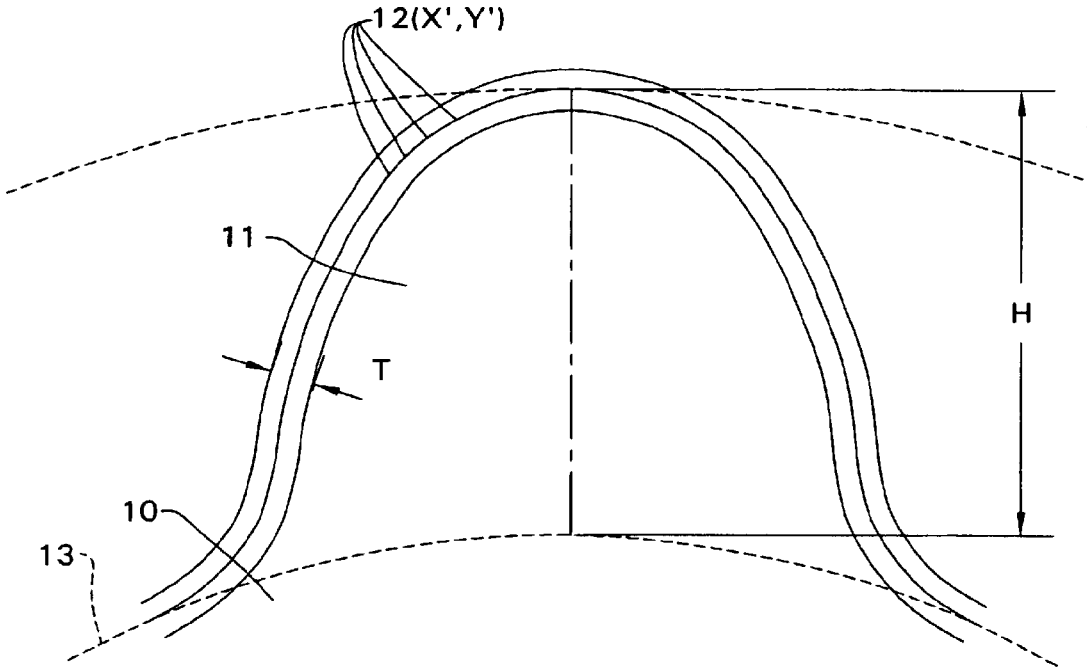
FIG. 1 shows the profile of a gear wheel tooth indicating the band of tolerance of the profile relative to the depth of the tooth.

With reference to FIG. 1, a gear wheel 10 according to the invention, designed to mesh with another corresponding gear wheel (not shown) for use in a rotary positive-displacement pump, preferably of the type for high operating pressures, comprises a plurality of teeth 11 with a depth H and a profile capable of meshing without encapsulation with the teeth of the other corresponding gear wheel. The profile of the teeth 11 is not describable as a succession of simple geometric curves, but can be defined by a natural spline function passing through a plurality of nodal points 12 defined by pairs of values expressed in a system of Cartesian coordinates having their origin at the centre O of the pitch circle 13 of the gear wheel 10.

Experiments led to the identification of a series of tooth profiles especially suitable for producing gear wheels with five, six, seven, eight, nine or ten teeth each. The actual profile of the teeth 11 may fall within a band of tolerance T the width of which is ±1/20th of the depth H of the tooth of the gear wheel.

EXAMPLE 1

Figure 2:
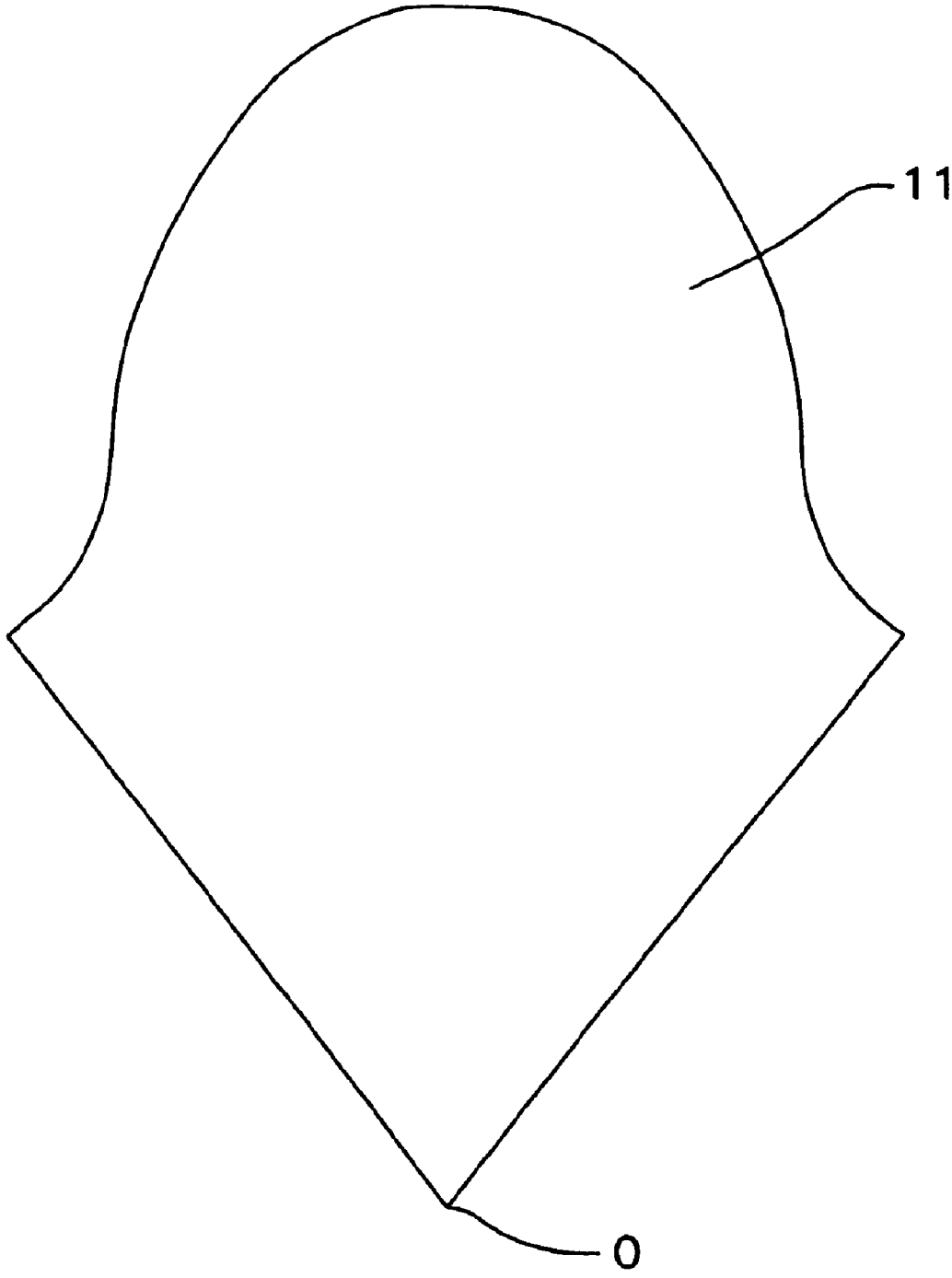
FIGS. 2 to 7 illustrate theoretical profiles of teeth of gear wheels having numbers of teeth respectively equal to five, six, seven, eight, nine and ten.

A gear wheel having a number of teeth equal to five has a theoretical tooth profile illustrated in FIG. 2, defined by a natural spline function passing through a plurality of nodal points defined by a pair of values {X', Y'} expressed in a system of Cartesian coordinates having their origin at the centre O of the pitch circle P of the gear wheel. The coordinates of the nodal points vary in a manner similar to the pairs of values {X, Y} in the list shown in table 1 below.

TABLE 1

| X | Y | X | Y | X | Y | X | Y |
|---|---|---|---|---|---|---|---|
| 0.00 | 20.00 | 3.93 | 17.22 | 5.15 | 14.26 | 5.43 | 11.85 |
| 0.37 | 19.98 | 4.02 | 17.07 | 5.20 | 14.09 | 5.45 | 11.78 |
| 0.73 | 19.93 | 4.11 | 16.91 | 5.21 | 13.91 | 5.47 | 11.69 |
| 1.09 | 19.85 | 4.19 | 16.75 | 5.26 | 13.74 | 5.50 | 11.62 |
| 1.44 | 19.74 | 4.27 | 16.59 | 5.29 | 13.56 | 5.52 | 11.54 |
| 1.78 | 19.58 | 4.35 | 16.43 | 5.32 | 13.38 | 5.55 | 11.46 |
| 2.09 | 19.40 | 4.42 | 16.27 | 5.34 | 13.21 | 5.58 | 11.37 |
| 2.39 | 19.19 | 4.49 | 16.11 | 5.35 | 13.03 | 5.61 | 11.29 |
| 2.66 | 18.97 | 4.57 | 15.95 | 5.36 | 12.85 | 5.64 | 11.21 |
| 2.91 | 18.71 | 4.63 | 15.78 | 5.36 | 12.77 | 5.67 | 11.13 |
| 3.13 | 18.44 | 4.69 | 15.62 | 5.35 | 12.68 | 5.71 | 11.04 |
| 3.24 | 18.29 | 4.77 | 15.45 | 5.34 | 12.51 | 5.75 | 10.97 |
| 3.34 | 18.14 | 4.83 | 15.28 | 5.35 | 12.43 | 5.99 | 10.54 |
| 3.45 | 17.99 | 4.89 | 15.12 | 5.36 | 12.26 | 6.20 | 10.25 |
| 3.55 | 17.83 | 4.94 | 14.95 | 5.37 | 12.17 | 6.43 | 9.99 |
| 3.65 | 17.68 | 5.01 | 14.78 | 5.38 | 12.09 | 6.67 | 9.75 |
| 3.74 | 17.53 | 5.05 | 14.61 | 5.40 | 12.02 | 6.93 | 9.54 |
| 3.84 | 17.37 | 5.12 | 14.43 | 5.41 | 11.93 | | |

EXAMPLE 2

Figure 3:
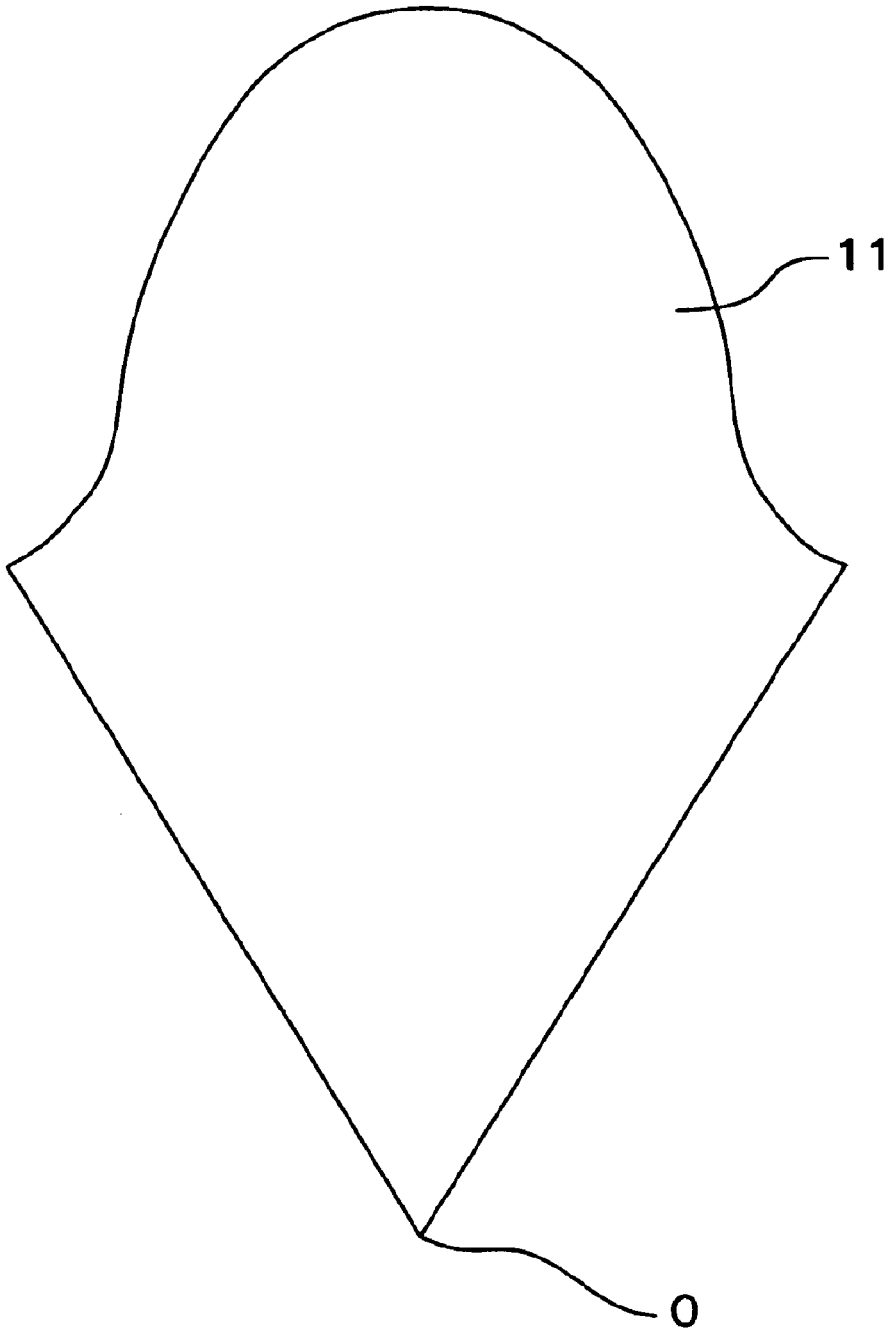

A gear wheel having a number of teeth equal to six has a theoretical tooth profile illustrated in FIG. 3, defined by a natural spline function passing through a plurality of nodal points defined by a pair of values {X', Y'} expressed in a system of Cartesian coordinates having their origin at the centre O of the pitch circle P of the gear wheel. The coordinates of the nodal points vary in a manner similar to the pairs of values {X, Y} in the list shown in table 2 below.

TABLE 2

| X | Y | X | Y | X | Y | X | Y |
|---|---|---|---|---|---|---|---|
| 0.00 | 19.50 | 3.51 | 16.75 | 4.45 | 13.98 | 4.59 | 12.75 |
| 0.34 | 19.48 | 3.58 | 16.64 | 4.48 | 13.86 | 4.60 | 12.71 |
| 0.68 | 19.43 | 3.65 | 16.53 | 4.49 | 13.72 | 4.62 | 12.66 |
| 1.01 | 19.34 | 3.71 | 16.40 | 4.49 | 13.59 | 4.62 | 12.61 |
| 1.33 | 19.24 | 3.77 | 16.27 | 4.48 | 13.66 | 4.63 | 12.56 |
| 1.64 | 19.09 | 3.83 | 16.14 | 4.47 | 13.61 | 4.65 | 12.51 |
| 1.92 | 18.89 | 3.94 | 15.88 | 4.48 | 13.56 | 4.67 | 12.42 |
| 2.19 | 18.69 | 4.00 | 15.74 | 4.48 | 13.49 | 4.68 | 12.36 |
| 2.43 | 18.46 | 4.05 | 15.60 | 4.47 | 13.44 | 4.71 | 12.30 |
| 2.65 | 18.21 | 4.06 | 15.46 | 4.47 | 13.37 | 4.85 | 11.99 |
| 2.83 | 17.94 | 4.10 | 15.33 | 4.47 | 13.31 | 4.99 | 11.74 |
| 2.90 | 17.81 | 4.15 | 15.19 | 4.48 | 13.25 | 5.12 | 11.55 |
| 2.98 | 17.70 | 4.20 | 15.05 | 4.49 | 13.18 | 5.28 | 11.37 |
| 3.04 | 17.57 | 4.24 | 14.92 | 4.50 | 13.13 | 5.44 | 11.20 |
| 3.12 | 17.45 | 4.28 | 14.77 | 4.52 | 13.06 | 5.61 | 11.04 |
| 3.18 | 17.32 | 4.31 | 14.64 | 4.53 | 13.01 | 5.78 | 10.91 |
| 3.25 | 17.25 | 4.34 | 14.51 | 4.55 | 12.95 | 5.97 | 10.78 |
| 3.32 | 17.12 | 4.38 | 14.38 | 4.56 | 12.91 | 6.18 | 10.65 |
| 3.37 | 16.99 | 4.41 | 14.25 | 4.57 | 12.85 | | |
| 3.44 | 16.88 | 4.43 | 14.11 | 4.58 | 12.81 | | |

EXAMPLE 3

Figure 4:
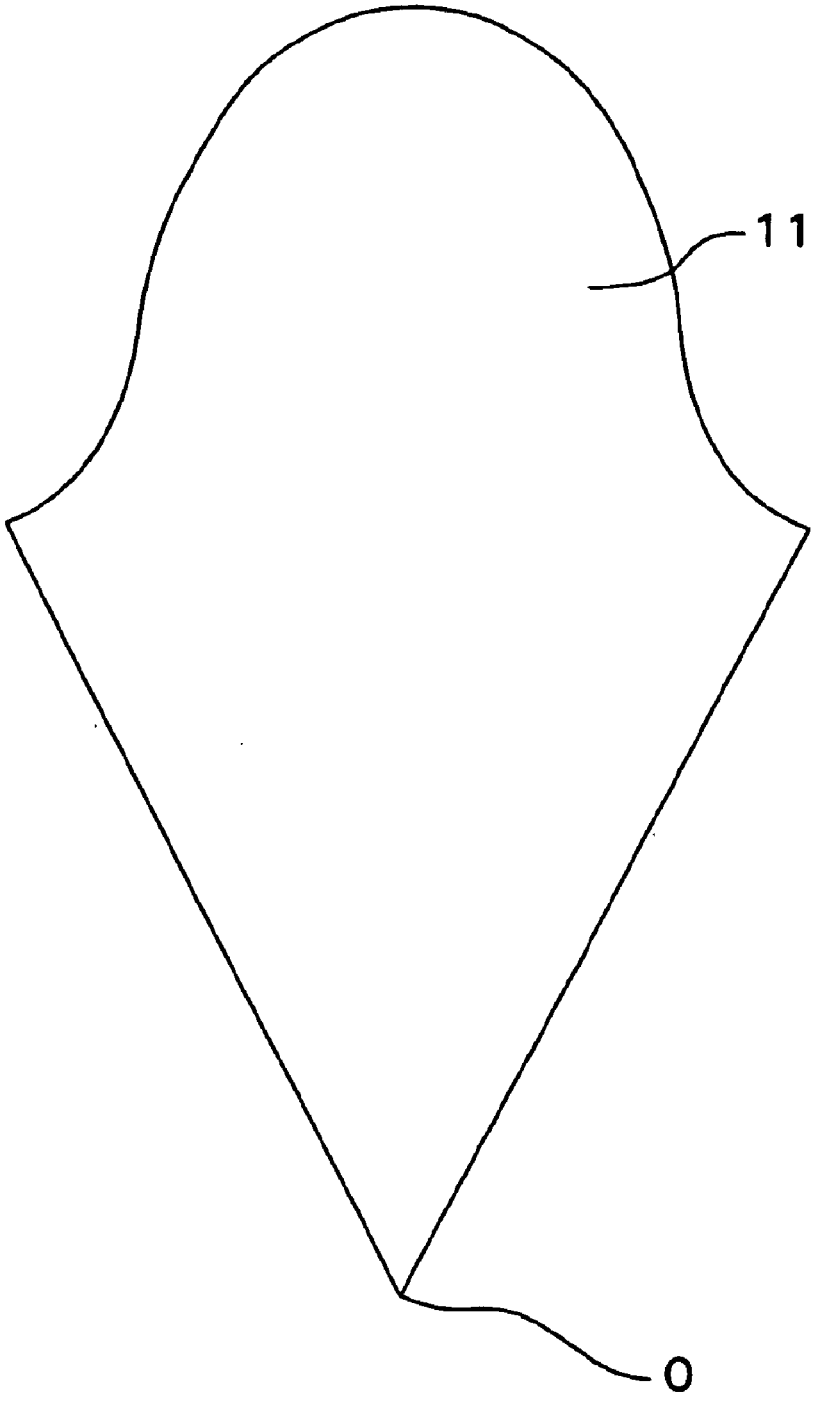

A gear wheel having a number of teeth equal to seven has a theoretical tooth profile illustrated in FIG. 4, defined by a natural spline function passing through a plurality of nodal points defined by a pair of values {X', Y'} expressed in a system of Cartesian coordinates having their origin at the centre O of the pitch circle P of the gear wheel. The coordinates of the nodal points vary in a manner similar to the pairs of values {X, Y} in the list shown in table 3 below.

TABLE 3

| X | Y | X | Y | X | Y | X | Y |
|---|---|---|---|---|---|---|---|
| 0.00 | 19.10 | 3.05 | 16.72 | 3.76 | 14.75 | 4.03 | 13.16 |
| 0.33 | 19.09 | 3.12 | 16.61 | 3.73 | 14.60 | 4.05 | 13.10 |
| 0.64 | 19.05 | 3.18 | 16.52 | 3.76 | 14.50 | 4.06 | 13.05 |
| 0.95 | 18.96 | 3.19 | 16.41 | 3.76 | 14.39 | 4.07 | 12.98 |
| 1.25 | 18.83 | 3.25 | 16.32 | 3.82 | 14.28 | 4.09 | 12.95 |
| 1.53 | 18.69 | 3.25 | 16.21 | 3.84 | 14.19 | 4.13 | 12.86 |
| 1.79 | 18.49 | 3.32 | 16.09 | 3.85 | 14.04 | 4.18 | 12.79 |
| 2.04 | 18.28 | 3.34 | 15.98 | 3.86 | 13.85 | 4.25 | 12.62 |
| 2.25 | 18.09 | 3.43 | 15.88 | 3.88 | 13.76 | 4.33 | 12.45 |
| 2.45 | 17.83 | 3.42 | 15.79 | 3.86 | 13.73 | 4.51 | 12.27 |
| 2.59 | 17.58 | 3.46 | 15.67 | 3.86 | 13.67 | 4.57 | 12.15 |
| 2.65 | 17.46 | 3.53 | 15.57 | 3.89 | 13.60 | 4.77 | 11.98 |
| 2.67 | 17.37 | 3.52 | 15.46 | 3.90 | 13.56 | 4.84 | 11.88 |
| 2.78 | 17.29 | 3.59 | 15.37 | 3.92 | 13.48 | 4.95 | 11.75 |
| 2.83 | 17.17 | 3.61 | 15.28 | 3.94 | 13.45 | 5.11 | 11.67 |
| 2.88 | 17.12 | 3.65 | 15.17 | 3.94 | 13.36 | 5.29 | 11.55 |
| 2.94 | 17.01 | 3.68 | 15.06 | 3.96 | 13.31 | 5.43 | 11.49 |
| 2.95 | 16.92 | 3.66 | 14.96 | 3.97 | 13.25 | 5.51 | 11.45 |
| 3.03 | 16.81 | 3.74 | 14.84 | 3.99 | 13.24 | | |

EXAMPLE 4

Figure 5:
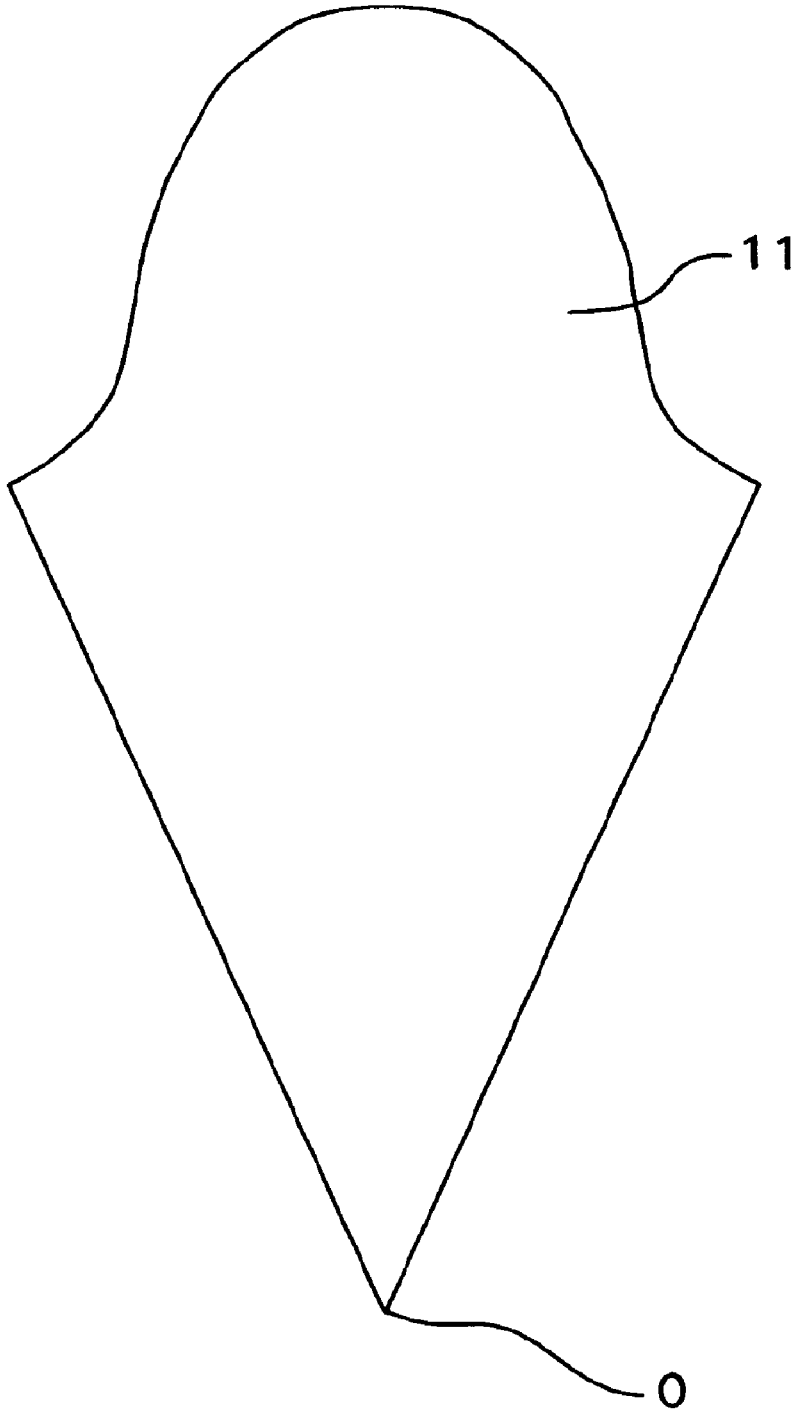

A gear wheel having a number of teeth equal to eight has a theoretical tooth profile illustrated in FIG. 5, defined by a natural spline function passing through a plurality of nodal points defined by a pair of values {X', Y',} expressed in a system of Cartesian coordinates having their origin at the centre O of the pitch circle P of the gear wheel. The coordinates of the nodal points vary in a manner similar to the pairs of values {X, Y} in the list shown in table 4 below.

TABLE 4

| X | Y | X | Y | X | Y | X | Y |
|---|---|---|---|---|---|---|---|
| 0.00 | 18.80 | 2.66 | 16.68 | 3.24 | 14.92 | 3.50 | 13.67 |
| 0.29 | 18.78 | 2.70 | 16.59 | 3.26 | 14.83 | 3.50 | 13.61 |
| 0.58 | 18.73 | 2.74 | 16.50 | 3.27 | 14.73 | 3.56 | 13.40 |
| 0.88 | 18.65 | 2.77 | 16.41 | 3.30 | 14.63 | 3.63 | 13.25 |
| 1.15 | 18.53 | 2.80 | 16.33 | 3.31 | 14.55 | 3.71 | 13.12 |
| 1.41 | 18.39 | 2.83 | 16.26 | 3.32 | 14.45 | 3.77 | 13.00 |
| 1.64 | 18.22 | 2.87 | 16.17 | 3.34 | 14.37 | 3.85 | 12.86 |
| 1.87 | 18.03 | 2.91 | 16.09 | 3.35 | 14.29 | 3.94 | 12.74 |
| 2.05 | 17.83 | 2.94 | 16.00 | 3.37 | 14.15 | 4.02 | 12.64 |
| 2.21 | 17.61 | 2.98 | 15.93 | 3.38 | 14.13 | 4.12 | 12.55 |
| 2.36 | 17.36 | 3.01 | 15.84 | 3.39 | 14.06 | 4.22 | 12.47 |
| 2.40 | 17.28 | 3.04 | 15.76 | 3.41 | 14.02 | 4.32 | 12.38 |
| 2.45 | 17.20 | 3.08 | 15.67 | 3.42 | 13.97 | 4.42 | 12.30 |
| 2.48 | 17.12 | 3.10 | 15.59 | 3.44 | 13.92 | 4.52 | 12.24 |
| 2.52 | 17.04 | 3.12 | 15.49 | 3.46 | 13.83 | 4.64 | 12.18 |
| 2.56 | 16.94 | 3.15 | 15.42 | 3.46 | 13.78 | 4.74 | 12.12 |
| 2.59 | 16.85 | 3.18 | 15.22 | 3.47 | 13.75 | 4.87 | 12.08 |
| 2.63 | 16.77 | 3.20 | 15.12 | 3.49 | 13.72 | 4.97 | 12.01 |

EXAMPLE 5

Figure 6:
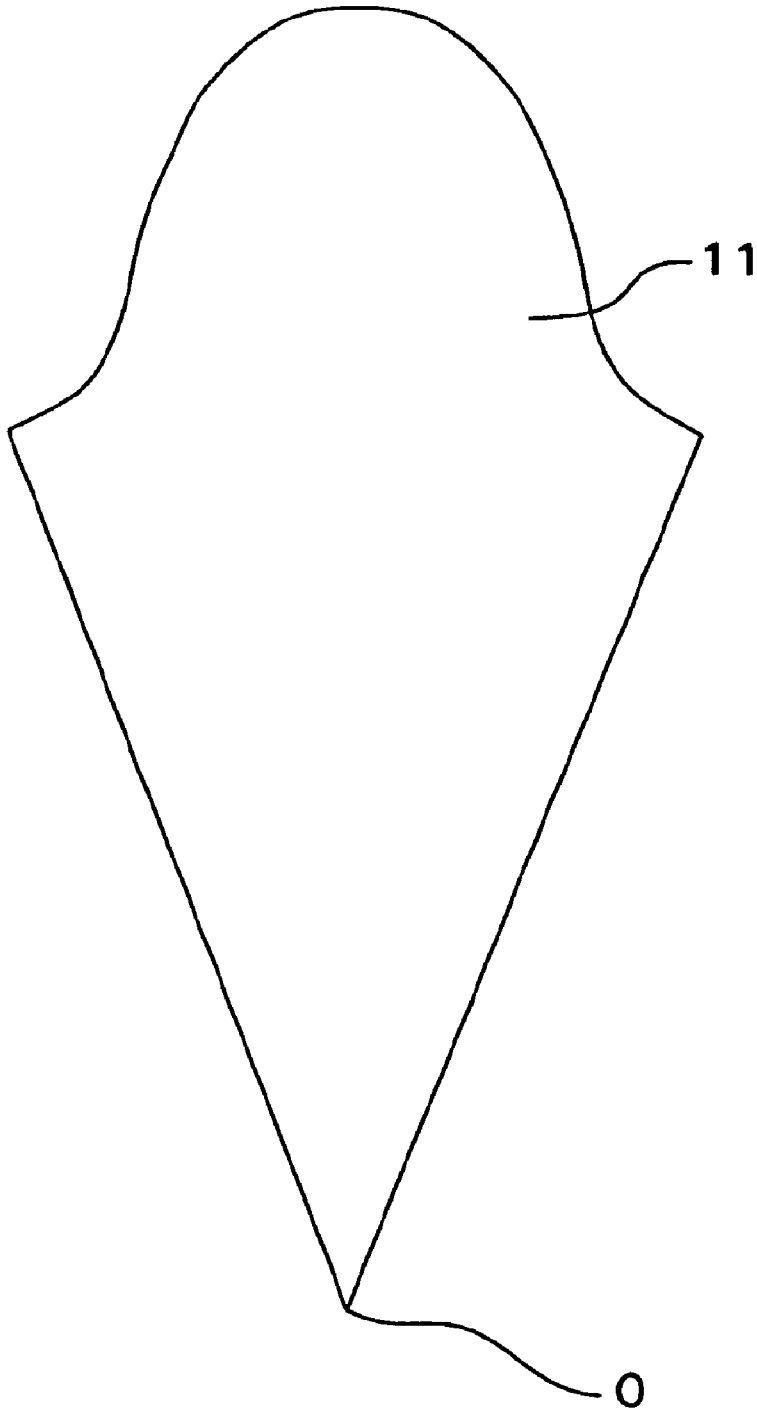

A gear wheel having a number of teeth equal to nine has a theoretical tooth profile illustrated in FIG. 6, defined by a natural spline function passing through a plurality of nodal points defined by a pair of values {X', Y'} expressed in a system of Cartesian coordinates having their origin at the centre O of the pitch circle P of the gear wheel. The coordinates of the nodal points vary in a manner similar to the pairs of values {X, Y} in the list shown in table 5 below.

TABLE 5

| X | Y | X | Y | X | Y | X | Y |
|---|---|---|---|---|---|---|---|
| 0.00 | 18.50 | 2.48 | 16.41 | 2.91 | 15.00 | 3.21 | 13.71 |
| 0.27 | 18.48 | 2.52 | 16.33 | 2.92 | 14.93 | 3.24 | 13.67 |
| 0.54 | 18.43 | 2.55 | 16.26 | 2.95 | 14.86 | 3.26 | 13.63 |
| 0.81 | 18.36 | 2.57 | 16.20 | 2.97 | 14.78 | 3.28 | 13.58 |
| 1.06 | 18.25 | 2.61 | 16.12 | 2.98 | 14.71 | 3.37 | 13.42 |
| 1.30 | 18.12 | 2.64 | 16.06 | 2.99 | 14.67 | 3.45 | 13.30 |
| 1.52 | 17.96 | 2.67 | 15.99 | 2.99 | 14.57 | 3.53 | 13.20 |
| 1.71 | 17.78 | 2.69 | 15.92 | 2.99 | 14.53 | 3.62 | 13.10 |
| 1.88 | 17.59 | 2.71 | 15.85 | 3.02 | 14.43 | 3.72 | 13.00 |
| 2.02 | 17.38 | 2.73 | 15.77 | 3.03 | 14.38 | 3.81 | 12.92 |
| 2.15 | 17.16 | 2.75 | 15.71 | 3.04 | 14.29 | 3.91 | 12.84 |
| 2.19 | 17.09 | 2.76 | 15.63 | 3.06 | 14.19 | 4.00 | 12.77 |
| 2.25 | 16.94 | 2.78 | 15.56 | 3.08 | 14.14 | 4.10 | 12.71 |
| 2.27 | 16.87 | 2.80 | 15.48 | 3.09 | 14.11 | 4.19 | 12.65 |
| 2.31 | 16.79 | 2.81 | 15.39 | 3.11 | 14.02 | 4.29 | 12.60 |
| 2.34 | 16.71 | 2.83 | 15.32 | 3.14 | 13.89 | 4.39 | 12.55 |
| 2.36 | 16.65 | 2.85 | 15.24 | 3.16 | 13.84 | 4.49 | 12.51 |
| 2.40 | 16.56 | 2.88 | 15.17 | 3.17 | 13.79 | | |
| 2.43 | 16.49 | 2.89 | 15.08 | 3.19 | 13.75 | | |

EXAMPLE 6

Figure 7:
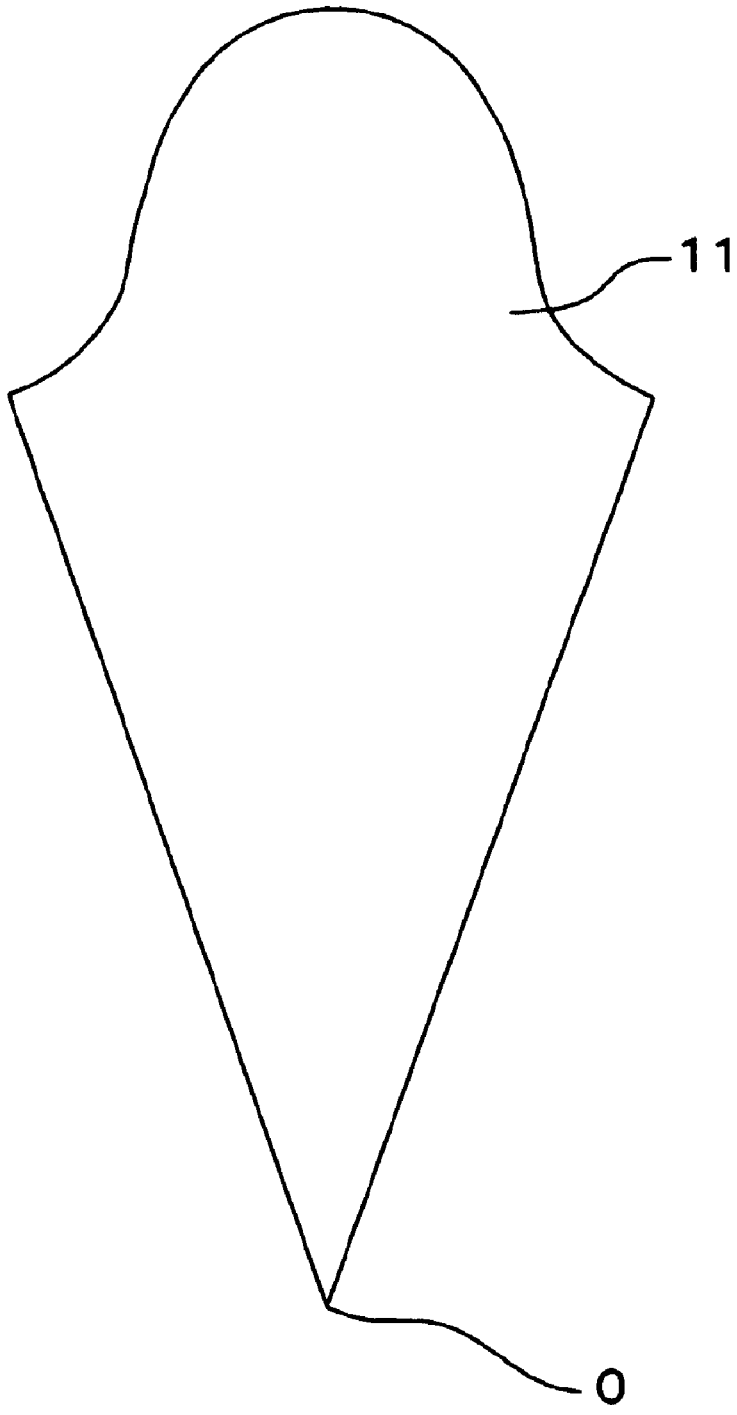

A gear wheel having a number of teeth equal to ten has a theoretical tooth profile illustrated in FIG. 7, defined by a natural spline function passing through a plurality of nodal points defined by a pair of values {X', Y'} expressed in a system of Cartesian coordinates having their origin at the centre O of the pitch circle P of the gear wheel. The coordinates of the nodal points vary in a manner similar to the pairs of values {X, Y} in the list shown in table 6 below.

TABLE 6

| X | Y | X | Y | X | Y | X | Y |
|---|---|---|---|---|---|---|---|
| 0.13 | 18.24 | 2.25 | 16.34 | 2.59 | 15.19 | 2.88 | 14.02 |
| 0.39 | 18.21 | 2.29 | 16.28 | 2.60 | 15.13 | 2.92 | 13.94 |
| 0.65 | 18.15 | 2.32 | 16.22 | 2.61 | 15.06 | 2.96 | 13.87 |
| 0.89 | 18.05 | 2.34 | 16.16 | 2.63 | 15.00 | 3.00 | 13.79 |
| 1.12 | 17.95 | 2.36 | 16.10 | 2.64 | 14.94 | 3.05 | 13.72 |
| 1.34 | 17.80 | 2.39 | 16.04 | 2.66 | 14.88 | 3.10 | 13.66 |
| 1.53 | 17.63 | 2.41 | 15.98 | 2.67 | 14.81 | 3.15 | 13.59 |
| 1.70 | 17.44 | 2.43 | 15.92 | 2.68 | 14.73 | 3.20 | 13.53 |
| 1.84 | 17.24 | 2.45 | 15.86 | 2.68 | 14.71 | 3.26 | 13.47 |
| 1.97 | 17.03 | 2.47 | 15.80 | 2.68 | 14.70 | 3.32 | 13.41 |
| 2.04 | 16.89 | 2.49 | 15.74 | 2.68 | 14.69 | 3.38 | 13.36 |
| 2.06 | 16.83 | 2.50 | 15.68 | 2.70 | 14.64 | 3.44 | 13.30 |
| 2.08 | 16.77 | 2.51 | 15.62 | 2.70 | 14.61 | 3.51 | 13.25 |
| 2.11 | 16.71 | 2.52 | 15.56 | 2.71 | 14.51 | 3.57 | 13.20 |
| 2.13 | 16.64 | 2.54 | 15.50 | 2.74 | 14.43 | 3.64 | 13.15 |
| 2.15 | 16.58 | 2.55 | 15.44 | 2.76 | 14.35 | 3.79 | 13.06 |
| 2.17 | 16.53 | 2.56 | 15.38 | 2.78 | 14.27 | 3.90 | 13.00 |
| 2.21 | 16.47 | 2.57 | 15.31 | 2.81 | 14.19 | 4.01 | 12.95 |
| 2.23 | 16.41 | 2.58 | 15.25 | 2.85 | 14.10 | 4.12 | 12.90 |

Once the centre-to-centre distance between the meshing gear wheels of the positive-displacement pump or one of the characteristic circles of the gears, for example the pitch circle or outside diameter, is known or defined, coordinate values {X', Y'} can be obtained from the pairs of values {X, Y} mentioned above by using simple conversion calculations. In this way, values representative of the points of the gear wheel tooth profiles are obtained and these can be used in conjunction with a gear-cutting machine of known type, in particular to control the path of the tool of a numerical control machine.

The production tolerance for the gear wheels must be such as to ensure that the profile of the teeth cut comes within a band of tolerance of ±1/20th of the depth of the tooth of the gear wheel.

I claim:

1. A gear wheel with a plurality of teeth capable of meshing with the teeth of another corresponding gear wheel, wherein the profile of each said tooth is within a band of tolerance of ±1/20th of the depth of the tooth with respect to a theoretical profile similar to a profile defined by a natural spline function passing through a plurality of nodal points having pre-established coordinates {X, Y} having their origin at the center of the pitch circle of the gear wheel, the natural spline function being selected from one of the groups of coordinates listed in tables 1 to 6, below, which correspond to the gear wheel with a number of teeth equal to five, six, seven, eight, nine or ten, respectively:

TABLE 1

| X | Y | X | Y | X | Y | X | Y |
|---|---|---|---|---|---|---|---|
| 0.00 | 20.00 | 3.93 | 17.22 | 5.15 | 14.26 | 5.43 | 11.85 |
| 0.37 | 19.98 | 4.02 | 17.07 | 5.20 | 14.09 | 5.45 | 11.78 |
| 0.73 | 19.93 | 4.11 | 16.91 | 5.21 | 13.91 | 5.47 | 11.69 |
| 1.09 | 19.85 | 4.19 | 16.75 | 5.26 | 13.74 | 5.50 | 11.62 |
| 1.44 | 19.74 | 4.27 | 16.59 | 5.29 | 13.56 | 5.52 | 11.54 |
| 1.78 | 19.58 | 4.35 | 16.43 | 5.32 | 13.38 | 5.55 | 11.46 |
| 2.09 | 19.40 | 4.42 | 16.27 | 5.34 | 13.21 | 5.58 | 11.37 |
| 2.39 | 19.19 | 4.49 | 16.11 | 5.35 | 13.03 | 5.61 | 11.29 |
| 2.66 | 18.97 | 4.57 | 15.95 | 5.36 | 12.85 | 5.64 | 11.21 |
| 2.91 | 18.71 | 4.63 | 15.78 | 5.36 | 12.77 | 5.67 | 11.13 |
| 3.13 | 18.44 | 4.69 | 15.62 | 5.35 | 12.68 | 5.71 | 11.04 |
| 3.24 | 18.29 | 4.77 | 15.45 | 5.34 | 12.51 | 5.75 | 10.97 |
| 3.34 | 18.14 | 4.83 | 15.28 | 5.35 | 12.43 | 5.99 | 10.54 |
| 3.45 | 17.99 | 4.89 | 15.12 | 5.36 | 12.26 | 6.20 | 10.25 |
| 3.55 | 17.83 | 4.94 | 14.95 | 5.37 | 12.17 | 6.43 | 9.99 |
| 3.65 | 17.68 | 5.01 | 14.78 | 5.38 | 12.09 | 6.67 | 9.75 |

TABLE 1-continued

| X | Y | X | Y | X | Y | X | Y |
|---|---|---|---|---|---|---|---|
| 3.74 | 17.53 | 5.05 | 14.61 | 5.40 | 12.02 | 6.93 | 9.54 |
| 3.84 | 17.37 | 5.12 | 14.43 | 5.41 | 11.93 | | |

TABLE 2

| X | Y | X | Y | X | Y | X | Y |
|---|---|---|---|---|---|---|---|
| 0.00 | 19.50 | 3.51 | 16.75 | 4.45 | 13.98 | 4.59 | 12.75 |
| 0.34 | 19.48 | 3.58 | 16.64 | 4.48 | 13.86 | 4.60 | 12.71 |
| 0.68 | 19.43 | 3.65 | 16.53 | 4.49 | 13.72 | 4.62 | 12.66 |
| 1.01 | 19.34 | 3.71 | 16.40 | 4.49 | 13.59 | 4.62 | 12.61 |
| 1.33 | 19.24 | 3.77 | 16.27 | 4.48 | 13.66 | 4.63 | 12.56 |
| 1.64 | 19.09 | 3.83 | 16.14 | 4.47 | 13.61 | 4.65 | 12.51 |
| 1.92 | 18.89 | 3.94 | 15.88 | 4.48 | 13.56 | 4.67 | 12.42 |
| 2.19 | 18.69 | 4.00 | 15.74 | 4.48 | 13.49 | 4.68 | 12.36 |
| 2.43 | 18.46 | 4.05 | 15.60 | 4.47 | 13.44 | 4.71 | 12.30 |
| 2.65 | 18.21 | 4.06 | 15.46 | 4.47 | 13.37 | 4.85 | 11.99 |
| 2.83 | 17.94 | 4.10 | 15.33 | 4.47 | 13.31 | 4.99 | 11.74 |
| 2.90 | 17.81 | 4.15 | 15.19 | 4.48 | 13.25 | 5.12 | 11.55 |
| 2.98 | 17.70 | 4.20 | 15.05 | 4.49 | 13.18 | 5.28 | 11.37 |
| 3.04 | 17.57 | 4.24 | 14.92 | 4.50 | 13.13 | 5.44 | 11.20 |
| 3.12 | 17.45 | 4.28 | 14.77 | 4.52 | 13.06 | 5.61 | 11.04 |
| 3.18 | 17.32 | 4.31 | 14.64 | 4.53 | 13.01 | 5.78 | 10.91 |
| 3.25 | 17.25 | 4.34 | 14.51 | 4.55 | 12.95 | 5.97 | 10.78 |
| 3.32 | 17.12 | 4.38 | 14.38 | 4.56 | 12.91 | 6.18 | 10.65 |
| 3.37 | 16.99 | 4.41 | 14.25 | 4.57 | 12.85 | | |
| 3.44 | 16.88 | 4.43 | 14.11 | 4.58 | 12.81 | | |

TABLE 3

| X | Y | X | Y | X | Y | X | Y |
|---|---|---|---|---|---|---|---|
| 0.00 | 19.10 | 3.05 | 16.72 | 3.76 | 14.75 | 4.03 | 13.16 |
| 0.33 | 19.09 | 3.12 | 16.61 | 3.73 | 14.60 | 4.05 | 13.10 |
| 0.64 | 19.05 | 3.18 | 16.52 | 3.76 | 14.50 | 4.06 | 13.05 |
| 0.95 | 18.96 | 3.19 | 16.41 | 3.76 | 14.39 | 4.07 | 12.98 |
| 1.25 | 18.83 | 3.25 | 16.32 | 3.82 | 14.28 | 4.09 | 12.95 |
| 1.53 | 18.69 | 3.25 | 16.21 | 3.84 | 14.19 | 4.13 | 12.86 |
| 1.79 | 18.49 | 3.32 | 16.09 | 3.85 | 14.04 | 4.18 | 12.79 |
| 2.04 | 18.28 | 3.34 | 15.98 | 3.86 | 13.85 | 4.25 | 12.62 |
| 2.25 | 18.09 | 3.43 | 15.88 | 3.88 | 13.76 | 4.33 | 12.45 |
| 2.45 | 17.83 | 3.42 | 15.79 | 3.86 | 13.73 | 4.51 | 12.27 |
| 2.59 | 17.58 | 3.46 | 15.67 | 3.86 | 13.67 | 4.57 | 12.15 |
| 2.65 | 17.46 | 3.53 | 15.57 | 3.89 | 13.60 | 4.77 | 11.98 |
| 2.67 | 17.37 | 3.52 | 15.46 | 3.90 | 13.56 | 4.84 | 11.88 |
| 2.78 | 17.29 | 3.59 | 15.37 | 3.92 | 13.48 | 4.95 | 11.75 |
| 2.83 | 17.17 | 3.61 | 15.28 | 3.94 | 13.45 | 5.11 | 11.67 |
| 2.88 | 17.12 | 3.65 | 15.17 | 3.94 | 13.36 | 5.29 | 11.55 |
| 2.94 | 17.01 | 3.68 | 15.06 | 3.96 | 13.31 | 5.43 | 11.49 |
| 2.95 | 16.92 | 3.66 | 14.96 | 3.97 | 13.25 | 5.51 | 11.45 |
| 3.03 | 16.81 | 3.74 | 14.84 | 3.99 | 13.24 | | |

TABLE 4

| X | Y | X | Y | X | Y | X | Y |
|---|---|---|---|---|---|---|---|
| 0.00 | 18.80 | 2.66 | 16.68 | 3.24 | 14.92 | 3.50 | 13.67 |
| 0.29 | 18.78 | 2.70 | 16.59 | 3.26 | 14.83 | 3.50 | 13.61 |
| 0.58 | 18.73 | 2.74 | 16.50 | 3.27 | 14.73 | 3.56 | 13.40 |
| 0.88 | 18.65 | 2.77 | 16.41 | 3.30 | 14.63 | 3.63 | 13.25 |
| 1.15 | 18.53 | 2.80 | 16.33 | 3.31 | 14.55 | 3.71 | 13.12 |
| 1.41 | 18.39 | 2.83 | 16.26 | 3.32 | 14.45 | 3.77 | 13.00 |
| 1.64 | 18.22 | 2.87 | 16.17 | 3.34 | 14.37 | 3.85 | 12.86 |
| 1.87 | 18.03 | 2.91 | 16.09 | 3.35 | 14.29 | 3.94 | 12.74 |
| 2.05 | 17.83 | 2.94 | 16.00 | 3.37 | 14.15 | 4.02 | 12.64 |
| 2.21 | 17.61 | 2.98 | 15.93 | 3.38 | 14.13 | 4.12 | 12.55 |
| 2.36 | 17.36 | 3.01 | 15.84 | 3.39 | 14.06 | 4.22 | 12.47 |
| 2.40 | 17.28 | 3.04 | 15.76 | 3.41 | 14.02 | 4.32 | 12.38 |
| 2.45 | 17.20 | 3.08 | 15.67 | 3.42 | 13.97 | 4.42 | 12.30 |
| 2.48 | 17.12 | 3.10 | 15.59 | 3.44 | 13.92 | 4.52 | 12.24 |
| 2.52 | 17.04 | 3.12 | 15.49 | 3.46 | 13.83 | 4.64 | 12.18 |
| 2.56 | 16.94 | 3.15 | 15.42 | 3.46 | 13.78 | 4.74 | 12.12 |

TABLE 4-continued

| X | Y | X | Y | X | Y | X | Y |
|---|---|---|---|---|---|---|---|
| 2.59 | 16.85 | 3.18 | 15.22 | 3.47 | 13.75 | 4.87 | 12.08 |
| 2.63 | 16.77 | 3.20 | 15.12 | 3.49 | 13.72 | 4.97 | 12.01 |

TABLE 4

| X | Y | X | Y | X | Y | X | Y |
|---|---|---|---|---|---|---|---|
| 0.00 | 18.50 | 2.48 | 16.41 | 2.91 | 15.00 | 3.21 | 13.71 |
| 0.27 | 18.48 | 2.52 | 16.33 | 2.92 | 14.93 | 3.24 | 13.67 |
| 0.54 | 18.43 | 2.55 | 16.26 | 2.95 | 14.86 | 3.26 | 13.63 |
| 0.81 | 18.36 | 2.57 | 16.20 | 2.97 | 14.78 | 3.28 | 13.58 |
| 1.06 | 18.25 | 2.61 | 16.12 | 2.98 | 14.71 | 3.37 | 13.42 |
| 1.30 | 18.12 | 2.64 | 16.06 | 2.99 | 14.67 | 3.45 | 13.30 |
| 1.52 | 17.96 | 2.67 | 15.99 | 2.99 | 14.57 | 3.53 | 13.20 |
| 1.71 | 17.78 | 2.69 | 15.92 | 2.99 | 14.53 | 3.62 | 13.10 |
| 1.88 | 17.59 | 2.71 | 15.85 | 3.02 | 14.43 | 3.72 | 13.00 |
| 2.02 | 17.38 | 2.73 | 15.77 | 3.03 | 14.38 | 3.81 | 12.92 |
| 2.15 | 17.16 | 2.75 | 15.71 | 3.04 | 14.29 | 3.91 | 12.84 |
| 2.19 | 17.09 | 2.76 | 15.63 | 3.06 | 14.19 | 4.00 | 12.77 |
| 2.25 | 16.94 | 2.78 | 15.56 | 3.08 | 14.14 | 4.10 | 12.71 |
| 2.27 | 16.87 | 2.80 | 15.48 | 3.09 | 14.11 | 4.19 | 12.65 |
| 2.31 | 16.79 | 2.81 | 15.39 | 3.11 | 14.02 | 4.29 | 12.60 |
| 2.34 | 16.71 | 2.83 | 15.32 | 3.14 | 13.89 | 4.39 | 12.55 |
| 2.36 | 16.65 | 2.85 | 15.24 | 3.16 | 13.84 | 4.49 | 12.51 |
| 2.40 | 16.56 | 2.88 | 15.17 | 3.17 | 13.79 | | |
| 2.43 | 16.49 | 2.89 | 15.08 | 3.19 | 13.75 | | |

TABLE 6

| X | Y | X | Y | X | Y | X | Y |
|---|---|---|---|---|---|---|---|
| 0.13 | 18.24 | 2.25 | 16.34 | 2.59 | 15.19 | 2.88 | 14.02 |
| 0.39 | 18.21 | 2.29 | 16.28 | 2.60 | 15.13 | 2.92 | 13.94 |
| 0.65 | 18.15 | 2.32 | 16.22 | 2.61 | 15.06 | 2.96 | 13.87 |
| 0.89 | 18.05 | 2.34 | 16.16 | 2.63 | 15.00 | 3.00 | 13.79 |
| 1.12 | 17.95 | 2.36 | 16.10 | 2.64 | 14.94 | 3.05 | 13.72 |
| 1.34 | 17.80 | 2.39 | 16.04 | 2.66 | 14.88 | 3.10 | 13.66 |
| 1.53 | 17.63 | 2.41 | 15.98 | 2.67 | 14.81 | 3.15 | 13.59 |
| 1.70 | 17.44 | 2.43 | 15.92 | 2.68 | 14.73 | 3.20 | 13.53 |
| 1.84 | 17.24 | 2.45 | 15.86 | 2.68 | 14.71 | 3.26 | 13.47 |
| 1.97 | 17.03 | 2.47 | 15.80 | 2.68 | 14.70 | 3.32 | 13.41 |
| 2.04 | 16.89 | 2.49 | 15.74 | 2.68 | 14.69 | 3.38 | 13.36 |
| 2.06 | 16.83 | 2.50 | 15.68 | 2.70 | 14.64 | 3.44 | 13.30 |
| 2.08 | 16.77 | 2.51 | 15.62 | 2.70 | 14.61 | 3.51 | 13.25 |
| 2.11 | 16.71 | 2.52 | 15.56 | 2.71 | 14.51 | 3.57 | 13.20 |
| 2.13 | 16.64 | 2.54 | 15.50 | 2.74 | 14.43 | 3.64 | 13.15 |
| 2.15 | 16.58 | 2.55 | 15.44 | 2.76 | 14.35 | 3.79 | 13.06 |
| 2.17 | 16.53 | 2.56 | 15.38 | 2.78 | 14.27 | 3.90 | 13.00 |
| 2.21 | 16.47 | 2.57 | 15.31 | 2.81 | 14.19 | 4.01 | 12.95 |
| 2.23 | 16.41 | 2.58 | 15.25 | 2.85 | 14.10 | 4.12 | 12.90. |

2. A rotary positive-displacement pump comprising two of said gear wheels according to claim 1, the gear wheels meshing with each other without encapsulation.

* * * * *